US012044432B2

(12) United States Patent
Yamashita et al.

(10) Patent No.: US 12,044,432 B2
(45) Date of Patent: Jul. 23, 2024

(54) HUMIDIFIER

(71) Applicant: DAIKIN INDUSTRIES, LTD., Osaka (JP)

(72) Inventors: Tetsuya Yamashita, Osaka (JP); Masato Miyagami, Osaka (JP); Hirokazu Doi, Osaka (JP); Takayoshi Okamoto, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 18/590,700

(22) Filed: Feb. 28, 2024

(65) Prior Publication Data

US 2024/0200824 A1 Jun. 20, 2024

Related U.S. Application Data

(63) Continuation of application No. PCT/JP2022/024661, filed on Jun. 21, 2022.

(30) Foreign Application Priority Data

Aug. 31, 2021 (JP) ..... 2021-140912

(51) Int. Cl.
*F24F 13/20* (2006.01)
*F24F 6/00* (2006.01)

(52) U.S. Cl.
CPC ..... *F24F 13/20* (2013.01); *F24F 6/00* (2013.01); *F24F 2006/008* (2013.01)

(58) Field of Classification Search
CPC ..... F24F 6/00; F24F 13/20; F24F 2006/008; F24F 2006/065

(Continued)

(56) References Cited

U.S. PATENT DOCUMENTS 5,765,544 A * 6/1998 Vigansky, Jr. ..... F24F 6/00 261/106
6,769,671 B2 * 8/2004 Rhea ..... G01F 23/292 261/107

(Continued)

FOREIGN PATENT DOCUMENTS

ES 2622101 T3 * 7/2017
JP 57-116026 U 1/1981

(Continued)

OTHER PUBLICATIONS

Partial English Translation of ES 2622101 T3 (Year: 2017).*

(Continued)

*Primary Examiner* — Charles S Bushey
(74) *Attorney, Agent, or Firm* — Global IP Counselors, LLP

(57) ABSTRACT

A humidifier includes a casing, an air passage, a humidifying section, a tray to supply water to the humidifying section, a tank to supply water to the tray, a water supply port, an openable and closable door, and an overflow control mechanism. The water supply port supplies water from outside into the tank. The water supply port is exposed to outside of the casing, is disposed inside the door, is provided in the tank, and shifts between a first position exposed to the outside of the casing when supplying the water, and a second position housed in the casing when supplying no water. The door is open in the first position, and closed in the second position. The tank is turnably supported by the casing. The water supply port shifts between the first position and the second position when the tank turns.

17 Claims, 8 Drawing Sheets

(58) Field of Classification Search
USPC ..... 261/72.1, 83
See application file for complete search history.

(56) References Cited

U.S. PATENT DOCUMENTS

| | | | | |
|---|---|---|---|---|
| 2013/0113123 | A1* | 5/2013 | Ahn | F24F 6/06 261/31 |
| 2016/0169542 | A1* | 6/2016 | Yoon | F24F 13/20 261/72.1 |
| 2016/0175757 | A1* | 6/2016 | Yoon | F24F 13/20 261/30 |
| 2021/0088075 | A1 | 3/2021 | Bae et al. | |

FOREIGN PATENT DOCUMENTS

| | | | |
|---|---|---|---|
| JP | 2000-283510 | A | 10/2000 |
| JP | 2016-3842 | A | 1/2016 |
| JP | 6486803 | B2 * | 3/2019 |
| JP | 6486803 | B2 * | 3/2019 |

OTHER PUBLICATIONS

English Abstract of JP 6486803 B2 (Year: 2019).*
International Search Report of corresponding PCT Application No. PCT/JP2022/024661 dated Aug. 30, 2022.
International Preliminary Report of corresponding PCT Application No. PCT/JP2022/024661 dated Mar. 14, 2024.

* cited by examiner

HUMIDIFIER

CROSS-REFERENCE TO RELATED APPLICATIONS

This is a continuation of International Application No. PCT/JP2022/024661 filed on Jun. 21, 2022, which claims priority to Japanese Patent Application No. 2021-140912, filed on Aug. 31, 2021. The entire disclosures of these applications are incorporated by reference herein.

BACKGROUND

Technical Field

The present disclosure relates to a humidifier.

Background Art

Japanese Unexamined Patent Publication No. 2016-3842 discloses a humidifier including a humidifying element, a storage configured to supply water to the humidifying element, and a tank for storing water. The tank includes a water supply port for supplying water stored inside to a water storage. The water supply port is provided with a water supply valve which also serves as a cap. The water supply valve is open when the tank is attached to the humidifier body so that the water supply port faces downward. When the water supply valve is open, water is supplied from the tank to the storage through the water supply port.

SUMMARY

A first aspect of the present disclosure is directed to a humidifier including a casing, an air passage in the casing, a humidifying section configured to humidify air flowing through the air passage, a tray configured to supply water to the humidifying section, a tank configured to supply water to the tray, a water supply port communicating with the tank, an openable and closable door, and an overflow control mechanism configured to guide water flowing out of the water supply port to the tray. The water supply port is configured to supply water from outside into the tank. The door is a part of a side surface of the casing. The water supply port is exposed to outside of the casing, is disposed inside the door, is provided in the tank, and shift between a first position in which the water supply port is exposed to the outside of the casing when supplying the water, and a second position in which the water supply port is housed in the casing when supplying no water. The door is open in the first position, and closed in the second position. The tank is turnably supported by the casing. The water supply port shifts between the first position and the second position when the tank turns.

DETAILED DESCRIPTION OF EMBODIMENT(S)

An embodiment of the present disclosure will be described with reference to the drawings. The following embodiment is merely an exemplary one in nature, and is not intended to limit the scope, applications, or use of the present invention. Features of the embodiments, variations, and other examples described below can be combined or partially substituted within the range where the present invention can be embodied.

(1) General Configuration of Humidifier

Figure 1:
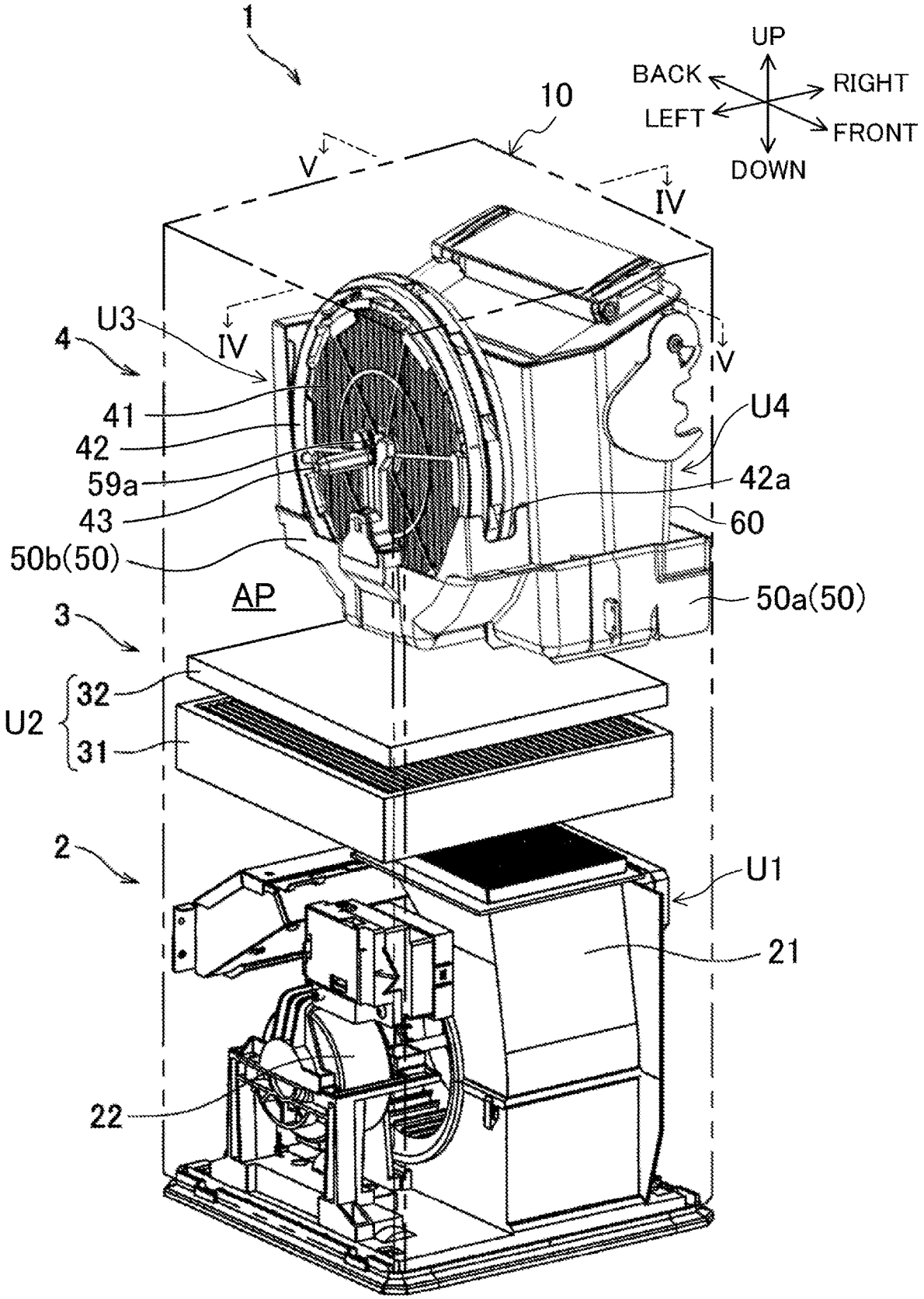
FIG. 1 is a perspective view showing an outline of a humidifier of an embodiment.
Figure 2A:
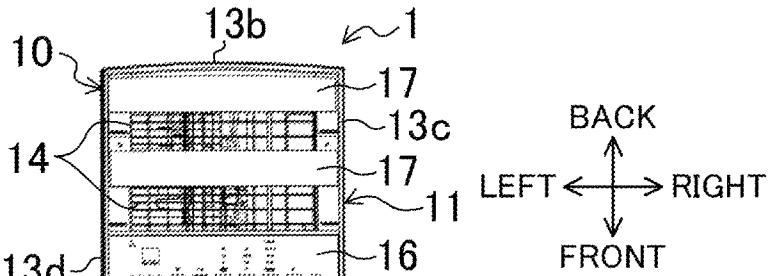
FIG. 2A is a plan view of the humidifier.
Figure 2D:
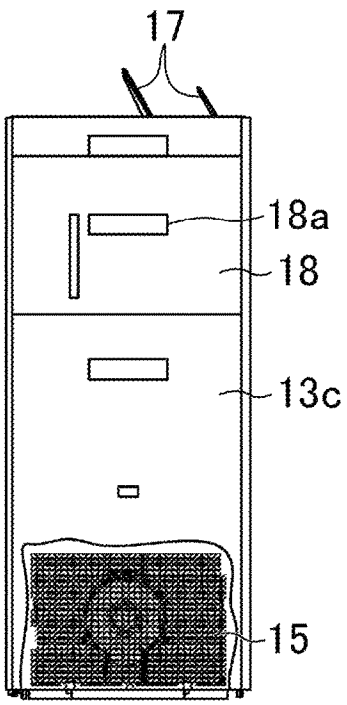
FIG. 2D is a right side view of the humidifier.
Figure 2C:
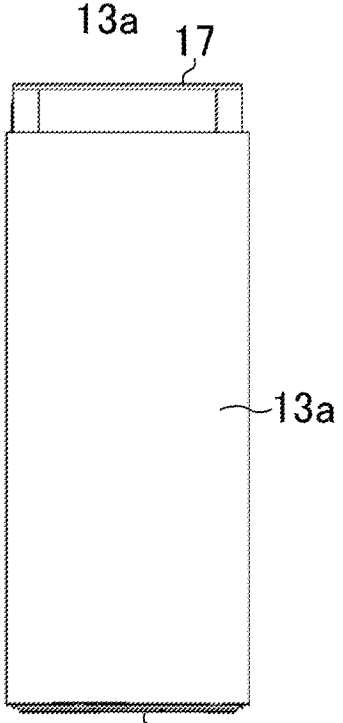
FIG. 2C is a front view of the humidifier.
Figure 2B:
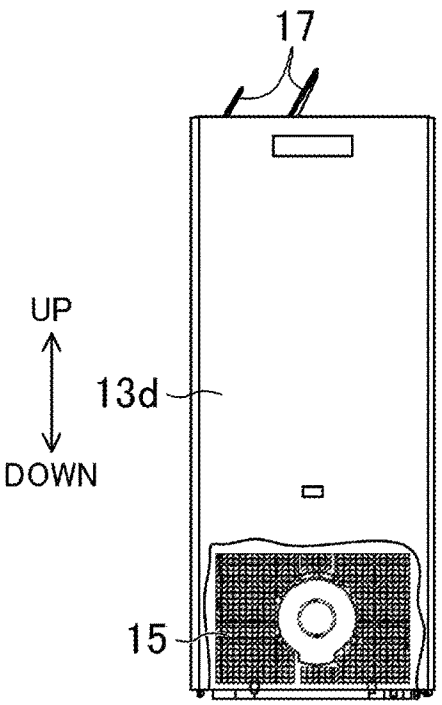
FIG. 2B is a left side view of the humidifier.
Figure 3A:
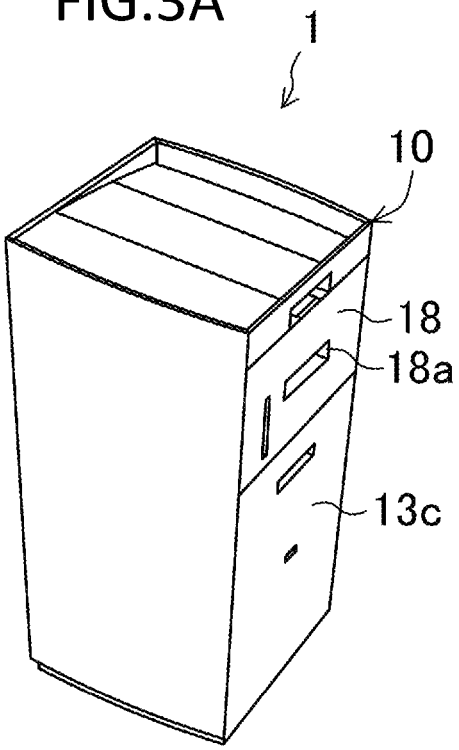
FIG. 3A is a perspective view of the humidifier in a second position.
Figure 3B:
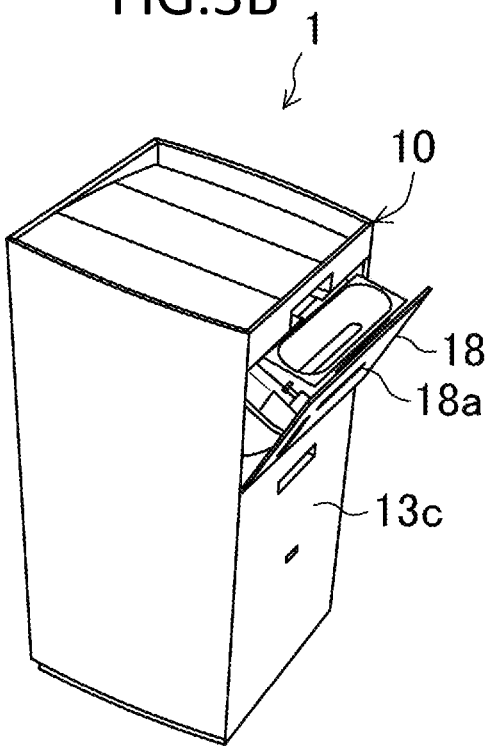
FIG. 3B is a perspective view of the humidifier in a first position.
Figure 3B:
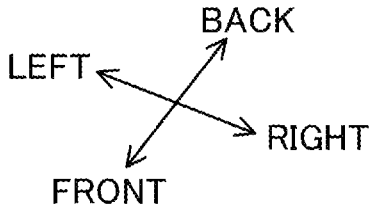

As shown in FIGS. 1 to 3, a humidifier (1) of this embodiment is of a floor-standing type to be placed indoors. The humidifier (1) has a humidifying function and an air purification function. A user can select the air purification function alone. When the user selects the humidification function, the air purification function is accompanied.

The humidifier (1) mainly includes a casing (10), a fan unit (U1), an air purification unit (U2), a humidifying unit (U3), and a water supply unit (U4). The humidifier (1) sequentially transfers sucked indoor air through the fan unit (U1), the air purification unit (U2), and the humidifying unit (U3) in order, and blows the air into a room. Each component will be described in detail below.

(2) Casing

The casing (10) is in a vertically long box shape. In the casing (10), an air passage (AP) extends vertically. In the air passage (AP), an air blow chamber (2), an air purification chamber (3), and a humidifying chamber (4) are arranged in this order from the bottom to the top.

The casing (10) includes a top plate (11), a bottom plate (12), and four side plates (13). The top plate (11) is provided with an operation panel (16). The operation panel (16) includes a power switch for selecting the start or stop of the humidifier (1), a button for selecting the start or stop of the humidifying function, and the like. The operation panel (16) includes a display (not shown) for displaying predetermined information. Examples of the predetermined information include information on the current indoor humidity, and the water level in a tray (50) described later. In the following description, "front", "back", "right", and "left" indicate the directions when the operation panel (16) is viewed from the front.

The top plate (11) includes outlets (14). The outlets (14) are located behind the operation panel (16). The outlets (14) extend over the entire transverse area. The outlets (14) are provided with two flaps (17). The flaps (17) are each in a horizontally long rectangular shape. The two flaps (17) are aligned in the front-to-back direction. Each flap (17) is turnably supported by the top plate (11), and opens and closes the outlets (14) and adjusts the wind direction.

The four side plates (13) includes a front panel (13*a*), a back panel (13*b*), a right side panel (13*c*), and a left side panel (13*d*). The right side panel (13*c*) and the left side panel (13*d*) each have a lower part provided with an inlet (15). The inlets (15) communicate with the air passage (AP) and sucks the air in the indoor space. Specifically, the inlet (15) is provided below the center of each side panel (13*c*, 13*d*) and substantially over the entire transverse area (in the front-to-back direction) of each side panel (13*c*, 13*d*). The inlet (15) is provided with a prefilter (not shown). The prefilter is disposed to cover the inlet (15). This enables collection of relatively large dust and the like. The bottom plate (12) closes the lower ends of the side plates (13).

(2-1-1) Side Door

The casing (10) is provided with a side door (18). The side door (18) is an example of the door (18) of the present disclosure. The side door (18) constitutes a part of a side surface of the casing (10). Specifically, the side door (18) constitutes a part of the right side panel (13*c*). The side door (18) is in a rectangular shape, and constitutes the part above the center of the right side panel (13*c*) and substantially over the entire area of the right side panel (13*c*) in the width direction (i.e., the front-to-back direction).

The side door (18) is openable and closable (see FIG. 3A and FIG. 3B). Specifically, the lower end of the side door (18) is turnably supported in the casing (10). By pulling a handle (18*a*) of the side door (18) forward, the side door (18) is inclined forward and the upper end is open. When fully open, the side door (18) is inclined at 25 to 45 degrees from the fully closed position in which the side door (18) is vertical.

In the following description, a first position represents the state in which the side door (18) is open (i.e., the state in FIG. 3B), and a second position represents the state in which the side door (18) is closed (i.e., the state of FIG. 3A). The term "open" means that the side door (18) is fully open, and "closed" means that the side door (18) is fully closed. A "first direction" represents the direction in which the side door (18) turns to incline from the second position to the first position, and a "second direction" represents the direction in which the side door (18) turns from the first position to the second position. Here, the side door (18) being fully open represent the state in which the side door (18) is supported in the first position without turning further in the first direction. In the first position, at least a part of the water supply port (67) may be exposed to the outside of the casing (10), while allowing water supply from the outside in a first water supply method which will be described later.

(3) Fan Unit

The fan unit (U1) is disposed in the air blow chamber (2). The fan unit (U1) faces the inlets (15). The fan unit (U1) includes a fan (21) and a fan motor (22).

The fan (21) is a sirocco fan. The fan (21) is driven by the fan motor (22) so as to rotate. The fan (21) sucks indoor air through the inlets (15) into the air blow chamber (2), and transfers the air to the air purification chamber (3) and then to the humidifying chamber (4) toward the outlets (14). In this manner, the fan (21) transfers the air in the air passage (AP) through the inlets (15) toward the outlets (14).

The air volume of the fan (21) is variable. Specifically, the number of rotations of the fan motor (22) is variable. The number of rotations of the fan motor (22) is switchable among a plurality of stages. The number of rotations of the fan motor (22) is controlled by the control unit (C).

(4) Air Purification Unit

The air purification unit (U2) is disposed in the air purification chamber (3). The air purification unit (U2) includes a dust collection filter (31) and a deodorizing filter (32). The dust collection filter (31) and the deodorizing filter (32) are arranged with their filter surfaces substantially horizontal at a height which is substantially the center of the casing (10).

The deodorizing filter (32) is disposed above the dust collection filter (31). In this air purification unit (U2), first, the dust collection filter (31) removes fine pollen, dust such as PM2.5, and the like. The formaldehyde, odorous components, and the like in the air having passed through the dust collection filter (31) are adsorbed or decomposed by the deodorizing filter (32) containing activated carbon or the like. In this manner, the air is purified while passing through the air purification unit (U2).

(5) Humidifying Unit

The humidifying unit (U3) is disposed in the humidifying chamber (4). The humidifying unit (U3) humidifies the air in the air passage (AP). The humidifying unit (U3) is an example of the humidifying unit (U3) of the present disclosure. The humidifying unit (U3) includes a vaporization filter (41) and a frame (42).

The vaporization filter (41) includes a vaporization material in a disk shape. The vaporization material is a non-woven fabric, for example. The water adheres to the vaporization material, and the moisture is then supplied to the air passing through the vaporization filter (41). The vaporization filter (41) is disposed with the filter surface facing transversely.

The frame (42) is made of a resin material in a ring shape. The inner frame of the frame (42) holds the vaporization filter (41). The frame (42) is, at center of the circle, provided with a first shaft (43). The first shaft (43) is connected to a motor (44) (see FIG. 4). When the motor (44) drives, the frame (42) and the vaporization filter (41) rotate integrally. The frame (42) is, at its lowest point, immersed in water in a second tray (50*b*) which will be described later.

Along the outer circumferential edge of the frame (42), a plurality of water scoops (42*a*) are aligned circumferentially. The plurality of water scoops (42*a*) are arranged at equal intervals. When the frame (42) rotates, one of the water scoops (42*a*) passing through the lowest point of the frame (42) collects water. In this manner, the plurality of water scoops (42*a*) sequentially collect the water in the tray (50).

The water scoops (42*a*) discharge the water toward the vaporization filter (41), when passing near the uppermost point of the frame (42). The water supply from these water scoops (42*a*) causes moisture to adhere to the vaporization filter (41). In this manner, the vaporization filter (41) rotates to be supplied with water. The vaporization filter (41), which rotates with the frame (42), is evenly supplied with the water from the water scoops (42*a*). When the air passes through the area of the vaporization filter (41) to which the water adheres, the air is supplied with moisture (i.e., humidified).

(6) Water Supply Unit

The water supply unit (U4) is disposed in the humidifying chamber (4). The water supply unit (U4) supplies the humidifying unit (U3) with water. The water supply unit (U4) is interposed between the humidifying unit (U3) and the side door (18). The water supply unit (U4) includes the tray (50) and a tank (60).

(6-1) Tray

Figure 4:
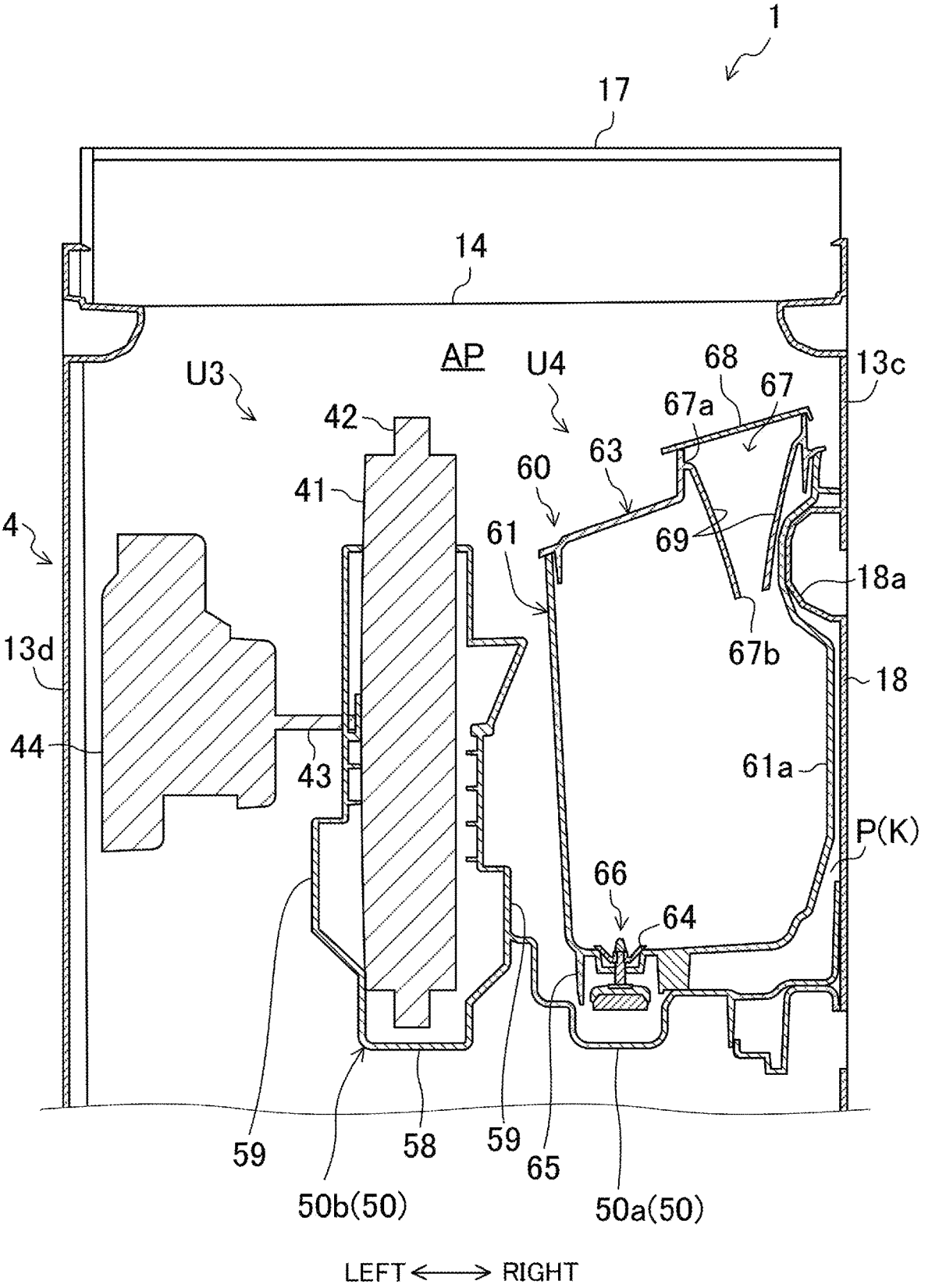
FIG. 4 is an enlarged view of a humidifying chamber in a cross section taken along the line IV-IV in FIG. 1.

As shown in FIGS. 1 and 4, the tray (50) is disposed in the humidifying chamber (4). The tray (50) is interposed between the humidifying unit (U3) and the side door (18). The tray (50) stores the water supplied from the tank (60). The tray (50) supplies the humidifying unit (U3) with water. The tray (50) includes a first tray (50*a*) and the second tray (50*b*). In the tray (50), the water can be exchanged between the first tray (50*a*) and the second tray (50*b*).

(6-1-1) First Tray

The first tray (50*a*) is disposed below the tank (60). The water stored in the tank (60) flows into the first tray (50*a*). The first tray (50*a*) has a bottom surface partially deep to mount a float (51) which will be described later. The first tray (50*a*) includes an antibacterial section (not shown). The antibacterial section is made of an antibacterial material and allows less mold and bacteria to glow in the water in the tray (50).

(6-1-2) Second Tray

The second tray (50*b*) is disposed below the frame (42). The second tray (50*b*) covers the bottom of the frame (42) to allow the water scoops (42*a*) to scoop water. In particular, the second tray (50*b*) includes a plate-shaped bottom (58) and two sidewalls (59). The bottom (58) is in a plate shape whose surface curves along the outer circumferential edge of the frame (42). The sidewalls (59) are each in a substantially semicircular shape. The two sidewalls (59) are connected to the bottom (58) so as to face each other.

The second tray (50*b*) includes a bearing (59*a*) which rotatably supports the first shaft (43) of the frame (42). The bearing (59*a*) extends upward from the center of one of the sidewalls (59).

(6-2) Float and Water Level Sensor

Figure 5:
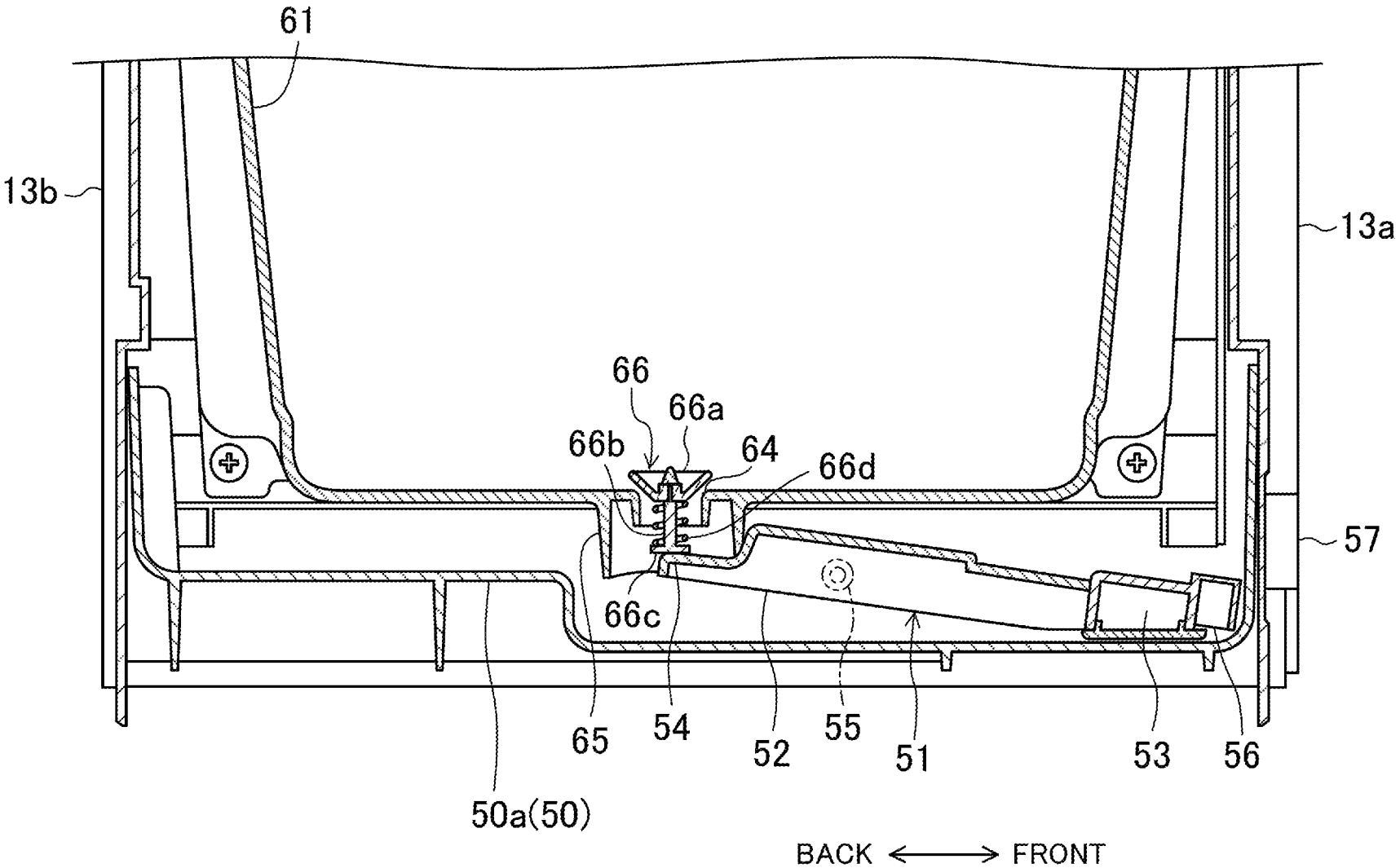
FIG. 5 is an enlarged view of a lower part of the humidifying chamber in a cross section taken along the line V-V in FIG. 1.

As shown in FIG. 5, the humidifier (1) of this example includes the float (51) and a water level sensor (57). The float (51) opens and closes a water supply valve (66) on the bottom surface of the tank (60) which will be described later. The water level sensor (57) detects the height of the water surface of the tray (50).

The float (51) includes a float body (52), a floater (53), a magnet (56), and a contact portion (54). The float body (52) extends from the right side surface of the first tray (50*a*) toward the center. The floater (53) is disposed near one end of the float body (52). The floater (53) is hollow to float on the water surface and moves up and down depending on the height of the water surface. The magnet (56) is disposed at one end of the float body (52) so as to face the inner surface of the tank (60). The magnet (56) moves up and down integrally with the float body (52). The contact portion (54) is located at the other end of the float body (52). The contact portion (54) is disposed directly below the water supply valve (66) which will be described later.

The float body (52) includes a side surface provided with a second shaft (55). The second shaft (55) is supported by the first tray (50*a*). The second shaft (55) is disposed at a point closer to the contact portion (54) between the floater (53) and the contact portion (54). In the float body (52), for example, when the floater (53) at one end of the float body (52) rises, the contact portion (54) at the other end lowers under the principle of seesaw.

The water level sensor (57) detects the height of the floater (53). The water level sensor (57) is a proximity sensor, for example. The water level sensor (57) detects the height of the floater (53) (i.e., the water level of the tray (50)) by causing the magnet (56) to approach the water level sensor (57) at a predetermined distance.

Specifically, when the water is supplied from the tray (50) to the humidifying unit (U3), the water level of the first tray (50*a*) (the tray (50)) lowers. Accordingly, the magnet (56) lowers together with the floater (53). When the magnet (56) has lowered to a predetermined height, the water level sensor (57) detects that the magnet (56) is out of the predetermined distance. On the other hand, when the water is supplied from the tank (60) to the tray (50), the water level of the first tray (50*a*) (the tray (50)) rises. Accordingly, the magnet (56) rises together with the floater (53). When the magnet (56) has risen to a predetermined height, the water level sensor (57) continues detecting that the magnet (56) is within the predetermined distance.

The water level sensor (57) transmits an ON signal to the control unit (C) to be described later when the magnet (56) is within a detectable distance, and transmits an OFF signal to the control unit (C) when the magnet (56) is out of the detectable distance, where the ON signal and OFF signal serve as signals indicating the information on the water level of the tray (50). Upon receipt of the OFF signal, the control unit (C) causes the operation panel (16) to display the tray (50) storing a relatively small amount of water.

(6-3) Tank

Figure 6:
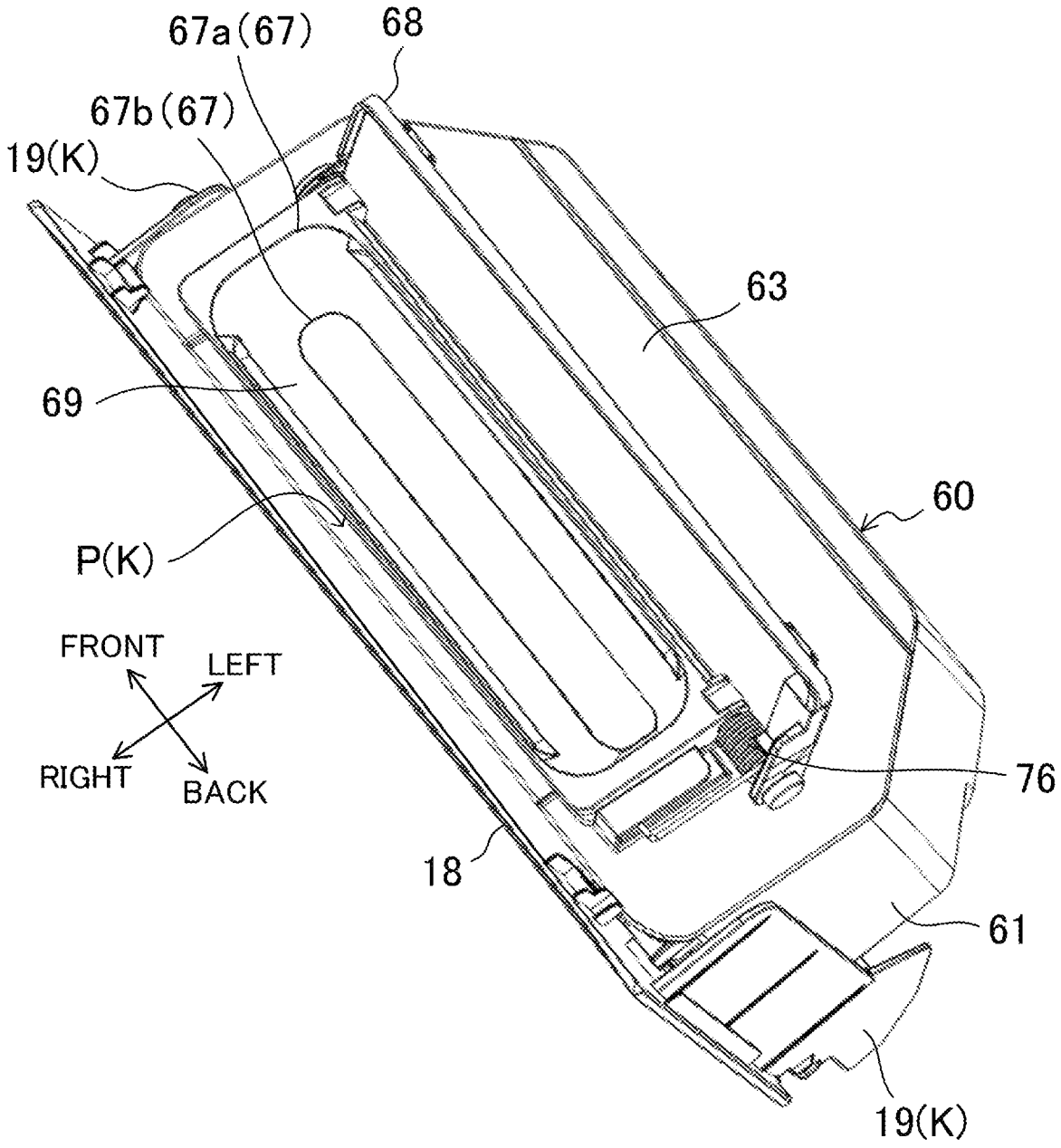
FIG. 6 is a perspective view showing a tank and a side door detached from a casing.

The tank (60) supplies water to the tray (50). The tank (60) is turnably supported by the casing (10). Specifically, as shown in FIGS. 4 to 6, the tank (60) is disposed inside the side door (18). The tank (60) turns as the side door (18) is open and closed. In other words, the first direction also represents the direction in which the tank (60) turns from the second position to the first position, and the second direction also represents the direction in which the tank (60) turns from the first position to the second position. The tank (60) is detachable from the casing (10). The tank (60) includes a tank body (61), the water supply valve (66), a water supply port (67), and a lid member (68).

(6-3-1) Tank Body

The tank body (61) is in a box shape. The tank body (61) has substantially the same length as the side door (18) in the width direction (i.e., the front-to-back direction). The tank body (61) has a slightly smaller depth (the length in the right-to-left direction) than the first tray (50*a*). The tank (60) has a detachable top lid (63). With the top lid (63) detached, the tank body (61) is open upward.

The tank (60) is disposed with the first side surface (61*a*) of the tank (60) extending along the inner surface of the side door (18). Specifically, the first side surface (61*a*) of the tank body (61) faces the inner surface of the side door (18).

Near the center of the bottom surface of the tank body (61), a circular communication hole (64) is open. The communication hole (64) allows the tank (60) and the tray (50) to communicate with each other. The water in the tank (60) flows into the tray (50) through the communication hole (64). The communication hole (64) is connected to a cylinder (65) extending downward toward the first tray (50*a*). The bottom surface of the tank body (61) is inclined so that the water flows toward the communication hole (64). The communication hole (64) is provided with the water supply valve (66). The water supply valve (66) opens and closes the communication hole (64).

(6-3-2) Water Supply Valve

The water supply valve (66) is an example of the opening and closing mechanism (66) of the present disclosure. The water supply valve (66) communicates with the tray (50).

The water supply valve (66) includes a valve body (66*a*), a valve stem (66*b*), a disk (66*c*), and a first spring member (66*d*).

The valve body (66*a*) closes the opening of the communication hole (64). Specifically, the valve body (66*a*) is in a conical shape bulging downward. The conical surface of the valve body (66*a*) comes into contact with the edge of the communication hole (64), thereby closing the communication hole (64).

The valve stem (66*b*) extends downward from the lower end of the valve body (66*a*). The valve stem (66*b*) is disposed in the cylinder (65). The valve stem (66*b*) is vertically movable in the cylinder (65). The disk (66*c*) is provided at the lower end of the valve stem (66*b*).

The disk (66*c*) has a larger diameter than the valve stem (66*b*). The disk (66*c*) is disposed directly above the contact portion (54) of the float (51). The disk (66*c*) comes into contact with the contact portion (54) depending on the water level of the first tray (50*a*).

The first spring member (66*d*) surrounds the valve stem (66*b*). In other words, the valve stem (66*b*) is inserted through the first spring member (66*d*). The first spring member (66*d*) biases the water supply valve (66) toward the first tray (50*a*). Specifically, the first spring member (66*d*) is fixed to the lower end of the cylinder (65), and the lower end of the first spring member (66*d*) presses the disk (66*c*) downward.

While the contact portion (54) of the float (51) is not in contact with the disk (66*c*), the water supply valve (66) closes the communication hole (64), which reduces flow of the water in the tank (60) (the tank body (61)) through the communication hole (64). On the other hand, when the contact portion (54) of the float (51) raises the disk (66*c*) (the state shown in FIG. 5), the water supply valve (66) rises, which enables flow of the water in the tank (60) (namely, the tank body (61)) toward the tray (50) through the communication hole (64). In this manner, the tray (50) is supplied with water when the water supply valve (66) is open, and supplied with no water when the water supply valve (66) is closed.

(6-3-3) Water Supply Port

The water supply port (67) is provided in the tank (60). The water supply port (67) communicates with the tank (60), and supplies water from the outside into the tank (60). Specifically, the water supply port (67) is provided in the top lid (63) and allows communication between the outside and the inside of the tank body (61). The opening of the water supply port (67) extends in the width direction (i.e., the front-to-back direction) of the top lid (63).

Since the tank (60) is fixed to the inside of the side door (18), the water supply port (67) is disposed inside the side door (18). Accordingly, when the side door (18) is in the first position, the water supply port (67) is exposed to the outside of the casing (10). When the side door (18) is in the second position, the water supply port (67) is housed in the casing (10). In this manner, the tank (60) turns to bring the water supply port (67) into the first position when supplying water, and the second position when supplying no water.

The water supply port (67) includes an inflow port (67*a*) and an outflow port (67*b*). The inflow port (67*a*) is located at the upper end of the water supply port (67). Water from the outside flows into the inflow port (67*a*). The outflow port (67*b*) is located at the lower end of the water supply port (67). The water having flowed in through the inflow port (67*a*) flows out into the tank (60) through the outflow port (67*b*). Both the inflow port (67*a*) and the outflow port (67*b*) are in a rectangular shape in the width direction (i.e., the front-to-back direction) of the top lid (63). The water supply port (67) includes an inclined surface (69) that is inclined so that an opening area of the water supply port (67) decreases from the inflow port (67*a*) toward the outflow port (67*b*). In this manner, the outflow port (67*b*) has a smaller opening area than the inflow port (67*a*).

(6-3-4) Lid Member

The lid member (68) is disposed in the water supply port (67) of the top lid (63). The lid member (68) can open and close the water supply port (67). Specifically, the lid member (68) is in a rectangular plate shape and covers the inflow port (67*a*) of the water supply port (67). As viewed from the right, the lid member (68) is supported such that the long side on the back is turnable, and opens from the front. The lid member (68) is provided with a second spring member (76) for biasing the lid member (68) in an opening direction.

(7) Overflow Control Mechanism

The humidifier (1) of this embodiment includes an overflow control mechanism (K). The overflow control mechanism (K) guides the water flowing out of the water supply port (67) to the tray (50). Specifically, the overflow control mechanism (K) includes a passage (P) and a pair of guards (19, 19). The passage (P) is a space between the inner surface of the side door (18) and the first side surface (61*a*) of the tank body (61) (see FIG. 4). The passage (P) has an open upper end and a lower end that communicates with the first tray (50*a*). Accordingly, the water flowing out of the water supply port (67) passes through the passage (P) and flows into the first tray (50*a*).

The guards (19) are each a plate-shaped member. The guards (19) are provided on the inner surface of the side door (18). The pair of guards (19, 19) are provided along the passage (P) so as to cover both ends of the first side surface (61*a*). Specifically, the pair of guards (19) extend vertically at both ends of the inner surface of the side door (18) in the width direction (i.e., the front-to-back direction). The space between the guards (19) and the side surface of the tank body (61) communicates with the first tray (50*a*). Accordingly, the water having flowed out of the water supply port (67) passes through the inside of the guards (19) and flows into the first tray (50*a*). The guards (19) are an example of the walls (19) of the present disclosure.

(8) Stopper

Figure 7A:
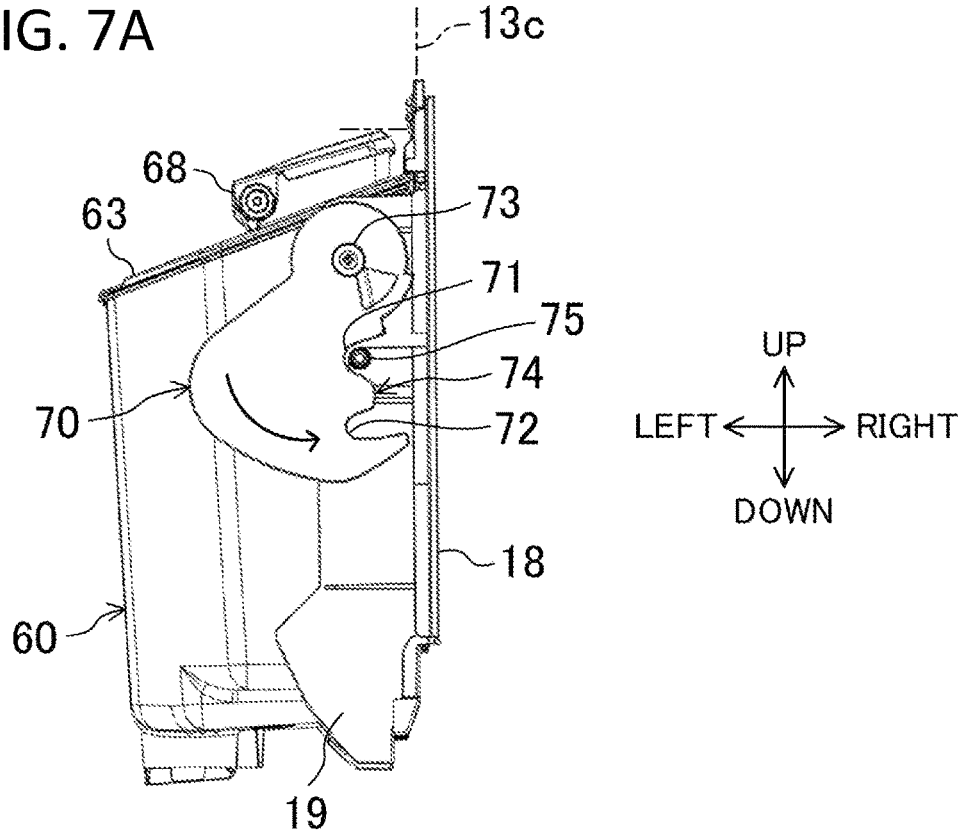
FIG. 7A is a front view showing the tank and a stopper in the second position.
Figure 7B:
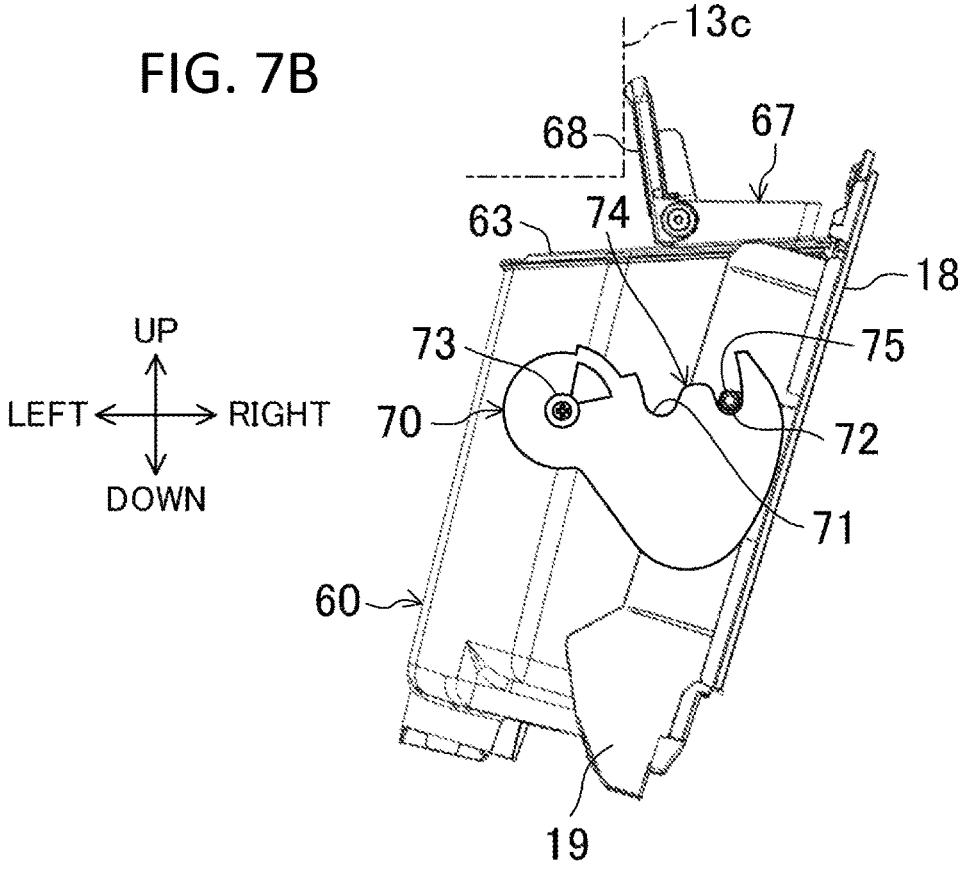
FIG. 7B is a front view showing the tank and the stopper in the first position.

As shown in FIG. 7A and FIG. 7B, the humidifier (1) of this embodiment includes a stopper (70). The stopper (70) is an example of the restricting member (70) of the present disclosure.

The stopper (70) is a plate-shaped member. The stopper (70) is turnably supported inside the front panel (13*a*) by a third shaft (73) provided at the top (see FIG. 1). The stopper (70) is biased by a spring member (not shown) so as to turn counterclockwise (along the arrow in FIG. 7A) as viewed from the front. A first engagement recess (71) and a second engagement recess (72) are aligned vertically along the right edge of the stopper (70). The first engagement recess (71) and the second engagement recess (72) fit with an engagement projection (75) projecting forward from the guard (19).

In the second position, the first engagement recess (71) fits with the engagement projection (75) (FIG. 7A). As the side door (18) is open (or as the side door (18) is inclined in the first direction), the engagement projection (75) moves from the first engagement recess (71) to the second engagement recess (72) while sliding on the right edge of the stopper (70). In the first position, the second engagement recess (72) fits with the engagement projection (75) (FIG. 7B). Accordingly, the stopper (70) restricts the tank (60) from inclining in the first direction from the first position.

(9) Control Unit

Figure 8:
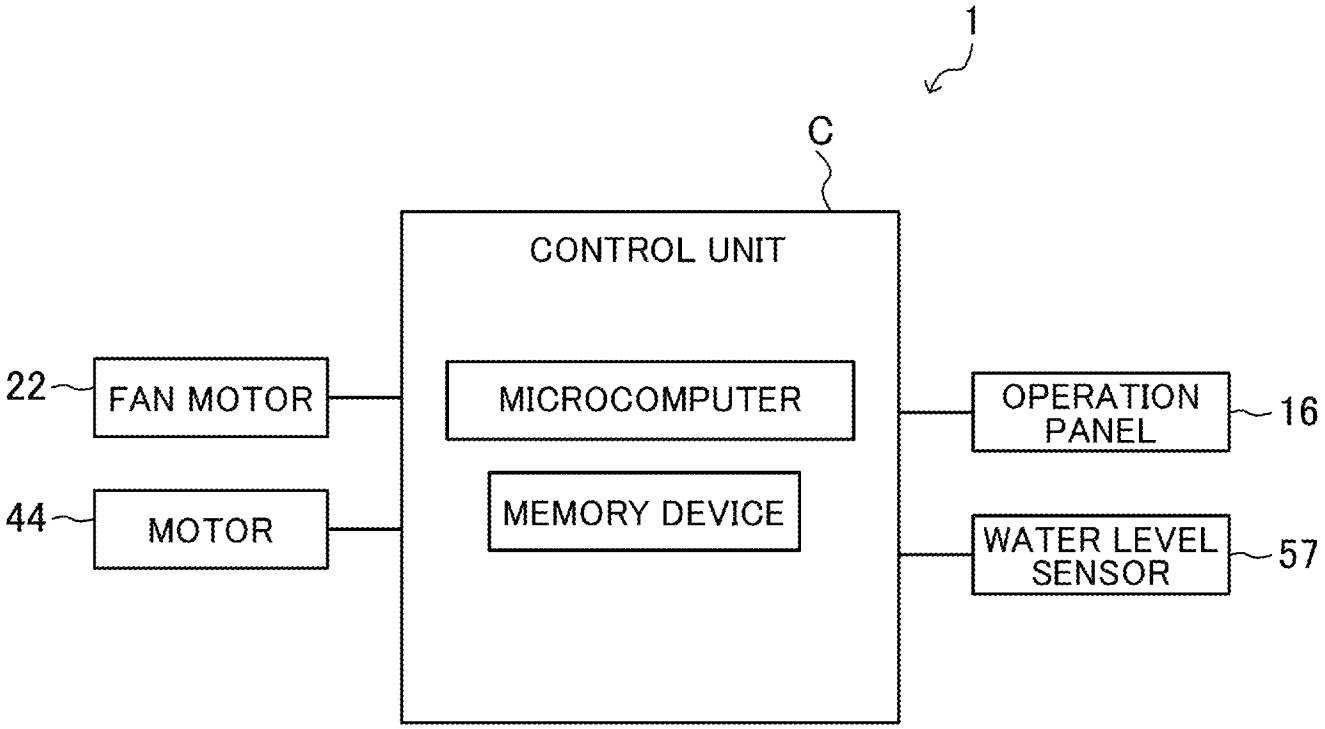
FIG. 8 is a block diagram showing the relationship between a control unit and various devices.

As shown in FIG. 8, the humidifier (1) includes a control unit (C). The control unit (C) controls the operation of the humidifier (1). The control unit (C) includes a microcomputer and a memory device for storing software for operating the microcomputer.

The control unit (C) is connected to various devices of the humidifier (1) in a wired or wireless manner. For example, the control unit (C) is connected to the water level sensor (57), the fan motor (22), the motor (44), and the operation panel (16). The control unit (C) controls the operations of various devices based on predetermined operation commands (e.g., commands to start and stop the humidifier (1), commands to start and stop the humidifying operation, and commands to start and stop the drying operation) transmitted from the operation panel (16).

(10) Operation of Humidifier

Next, various operations of the humidifier (1) of this embodiment will be described.

(10-1) Humidifying Operation

The humidifying operation includes purifying and humidifying sucked indoor air, and blowing the air into the indoor space again. When the humidifying operation is selected on the operation panel (16), the control unit (C) drives the fan motor (22) and the motor (44). The control unit (C) controls the number of rotations of the fan (21) and the vaporization filter (41) based on the set degree of humidification and the set air volume.

The rotating fan (21) rotates to transfer the indoor air having been sucked through the inlets (15), from the air blow chamber (2) to the air purification chamber (3). The air having been transferred to the air purification chamber (3) is purified by passing through the air purification unit (U2). The air having passed through the air purification unit (U2) is transferred to the humidifying chamber (4).

The air having flowed into the humidifying chamber (4) passes through the rotating vaporization filter (41). Since the vaporization filter (41) is supplied with water by the water scoops (42*a*) and thus has moisture attached thereto, the air passing through the vaporization filter (41) is supplied with moisture.

The moisture in the vaporization filter (41) is taken away by the passing air. However, since the vaporization filter (41) is rotating, the water scoops (42*a*) sequentially scoop the water in the second tray (50*b*) and supply the moisture to the vaporization filter (41) one after another. Accordingly, in the humidifying operation, the vaporization filter (41) always contains moisture and continues supplying the moisture to the air passing through the vaporization filter (41).

The air having been humidified in the humidifying chamber (4) is blown indoors from the outlets (14). When the indoor humidity reaches a target value, the control unit (C) stops the humidifying operation. Accordingly, the humidifying operation stops. In this example, in the humidifying operation, the following air purification operation is performed at the same time.

(10-2) Air Purification Operation

The air purification operation is an operation for purifying sucked indoor air. When the air purification operation is selected on the operation panel (16), the control unit (C) drives the fan motor (22). The fan motor (22) is driven to develop the air passage (AP) where an air flow of the indoor air sucked through the inlets (15) and flowing toward the outlets (14) is generated. The control unit (C) controls the number of revolutions of the fan (21) based on the set air volume.

The fan (21) rotates to transfer the indoor air having been sucked through the inlets (15), from the air blow chamber (2) to the air purification chamber (3). The air having been transferred to the air purification chamber (3) passes through the dust collection filter (31) and the deodorizing filter (32). The air having been purified in this manner is transferred to the humidifying chamber (4).

The air having flowed into the humidifying chamber (4) passes through the vaporization filter (41). While no humidifying operation is performed, the vaporization filter (41) stops and no moisture is thus supplied to the air passing through the vaporization filter (41). The air having passed through the vaporization filter (41) is blown into the room. Upon transmission of a command to stop the operation of the humidifier (1) from the operation panel (16) or after elapse of a predetermined time controlled by a timer or any other means, the control unit (C) stops the air purification operation.

(10-3) Drying Operation

The drying operation is an operation of drying the vaporization filter (41) by the air blown by the fan (21) after stop of the operation of the humidifier (1). The drying operation can dry the vaporization filter (41) in a shorter time than natural drying, which allows the vaporization filter (41) to have anti-mold or anti-odor properties.

The drying operation function can be turned on and off by on-site settings by a user. In this example, the drying operation function is turned on by sequentially pressing a plurality of buttons on the operation panel (16) in order as determined in advance.

When the drying operation function is turned on, the control unit (C) drives the fan motor (22) after stop of the operation of the humidifier (1) and executes the drying operation. In the drying operation, the control unit (C) controls the number of rotations of the fan (21) to obtain the minimum air volume.

The fan (21) rotates to transfer the indoor air having been sucked through the inlets (15), from the air blow chamber (2) to the air purification chamber (3), and then to the humidifying chamber (4). The air having flowed into the humidifying chamber (4) passes through the stopping vaporization filter (41). This air dries the vaporization filter (41). The air having passed through the vaporization filter (41) is blown into the room. After elapse of a predetermined time, the control unit (C) stops the drying operation.

(11) Water Supply to Humidifier

Next, a method of supplying water to the humidifier (1) of this embodiment will be described. The method of supplying water to the humidifier (1) includes the first water supply method and a second water supply method. The first water supply method is for supplying water into the tank (60) with the tank (60) attached to the casing (10). The second water supply method is for supplying water into the tank (60) with the tank (60) detached from the casing (10).

(11-1) First Water Supply Method

As shown in FIGS. 3 and 7, when the handle (18*a*) of the side door (18) in the second position is pulled forward, the side door (18) is inclined forward so that the upper end is gradually open. As the side door (18) is inclined in the first direction, the tank (60) is also gradually inclined in the first direction.

As the side door (18) is inclined, the lid member (68) is gradually open from the front. When the second engagement recess (72) of the stopper (70) fits with the engagement projection (75), the side door (18) is restricted so as not to turn further in the first direction, and shifts to the first position. In the first position, the lid member (68) is completely open, and the water supply port (67) shifts from the closed state to the open state. In this manner, the lid member (68) closes the water supply port (67) in the second position, and opens the water supply port (67) in the first position.

In this first position, when water is poured to the water supply port from a container (e.g., a kettle) containing water, the tank (60) gains weight and tries to turn in the second direction due to its own weight. However, the lid member (68) is biased to keep the water supply port (67) open with the upper surface of the lid member (68) pressing the right side panel (13*c*), which restricts a shift from the first position to the second position. This enables the side door (18) to be less likely to be closed by itself during the water supply to the tank (60). The water having spilled out in front of or on a side of the water supply port (67) or having flowed out of the water supply port during the water supply passes through the passage (P) or through the inside of the guards (19) and flows into the first tray (50*a*).

The water supply is completed once a predetermined amount of water is stored in the tank (60). After that, when the side door (18) is pushed in the second direction, the engagement projection (75) is disengaged from the second engagement recess (72) of the stopper (70), and the side door (18) shifts from the first position to the second position. Since the side door (18) moves in the second direction while the upper surface of the lid member (68) presses the right side panel (13*c*), the side door (18) is not suddenly closed. Accordingly, the user is less likely to get any finger caught in the side door (18).

When the side door (18) is closed to take the second position, the engagement projection (75) fits with the first engagement recess (71) of the stopper (70). In this state, water is supplied from the tank (60) to the tray (50). Specifically, if the water level of the first tray (50*a*) is lower than a predetermined water level, the contact portion (54) of the float (51) pushes up the disk (66*c*) of the water supply valve (66). Accordingly, the water supply valve (66) opens, such that the water in the tank (60) flows into the first tray (50*a*) through the communication hole (64) of the tank (60) (the tank body (61)). The water level in the first tray (50*a*) then rises, and the floater (53) also rises. As the floater (53) rises, the contact portion (54) lowers. When the first tray (50*a*) is filled with water at a predetermined water level, the contact portion (54) is separated from the disk (66*c*). When the contact portion (54) is completely separated from the disk (66*c*), the water supply valve (66) is closed, and the water supply from the tank (60) to the tray (50) stops.

(11-2) Second Water Supply Method

As in the first water supply method, the side door (18) shifts from the second position to the first position. When the stopper (70) is pushed downward in the first position, the second engagement recess (72) is disengaged from the engagement projection (75). Accordingly, the side door (18) and the tank (60) can be detached together from the casing (10). While holding the tank (60), the user moves to a kitchen, a washroom, or the like where water can be supplied, detaches the top lid (63) from the tank body (61), and directly supplies water to the tank body (61) through a faucet. In this case, since the top lid (63) is detached, a predetermined amount of water can be stored in the tank body (61) in a shorter time than when water is supplied through the water supply port (67). The water supply valve (66) closes the communication hole (64) using the first spring member (66*d*), which allows less water in the tank (60) to leak during the water supply.

With the top lid (63) attached to the tank body (61) again, the user moves to the humidifier (1) again. The engagement projection (75) comes into contact with the stopper (70) so as to turn the stopper (70) forward and then is pushed downward, such that the tank (60) and the side door (18) are attached to the casing (10). The side door (18) is pushed in the second direction with the right edge (74) of the stopper (70) in contact with the engagement projection (75), thereby bringing the side door (18) into the second position. In the second position, the engagement projection (75) is fitted into the first engagement recess (71) of the stopper (70). After that, water is supplied from the tank (60) to the tray (50) in the same manner as in the first water supply method.

(12) Features (12-1)

The humidifier (1) of this embodiment includes: the tray (50) configured to supply water to the humidifying unit (U3); the tank (60) configured to supply water to the tray (50); and the water supply port (67) communicating with the tank (60) and configured to supply water from outside into the tank (60). The water supply port (67) is exposed to the outside of the casing (10).

A typical humidifier for supplying water directly to the tank through a faucet requires a plurality of processes until the tank is detached from the humidifier body, supplied with water, and attached to the humidifier body again, where example of the processes include opening and closing of a cap of the water supply port and moving back forth and forth between the humidifier and the faucet. This may make a user feel inconvenient. To address the problem, in the humidifier (1) of this embodiment, the water supply port (67) is exposed to the outside of the casing (10), which allows the tank (60) to be directly supplied with water from the outside through the water supply port (67).

(12-2)

The water supply port (67) of the humidifier (1) of this embodiment shifts between a first position where the water supply port (67) is exposed to the outside of the casing (10) when supplying the water and a second position where the water supply port (67) is housed in the casing (10) when supplying no water. Thus, the water supply port (67) turns to the first position according to the timing of water supply, such that water can be supplied into the tank (60). When no water is supplied, the water supply port (67) turns to the second position, such that the water supply port (67) is housed in the casing (10), which allows less dust and the like to enter the water supply port (67).

(12-3)

The humidifier (1) of this embodiment further includes the side door (18) that is openable and closable and constitutes a part of a side surface of the casing (10). The water supply port (67) is disposed inside the side door (18). The side door (18) is open in the first position, and closed in the second position. Accordingly, the water supply port (67) can be shifted between the first position and the second position by opening and closing the side door (18). Water supply operation is easier through the side door (18) on the side surface of the casing (10) than through the top surface of the casing (10) when water is poured from a container such as a kettle into the water supply port, since there is no need to lift the kettle.

(12-4)

The humidifier (1) of this embodiment further includes the lid member (68) that is openable and closable and disposed in the water supply port (67). The lid member (68) is open and closed to expose the water supply port (67) to the outside only during water supply. Accordingly, when the lid member (68) is closed, less water can splash to the outside through the water supply port (67).

(12-5)

The lid member (68) of the humidifier (1) of this embodiment shifts to open the water supply port (67) in the first position and shifts to close the water supply port (67) in the second position. In the second position, when the flaps (17) are open, dust and the like in the air enter the casing (10) through the outlets (14). However, in the second position, since the lid member (68) closes the water supply port (67), less dust can enter the water supply port (67).

(12-6)

In the first position, the lid member (68) of the humidifier (1) of this embodiment is biased to keep the water supply port (67) open and to restrict a shift from the first position to the second position. Accordingly, water can be supplied into the tank (60) without opening the lid member (68). In addition, the shift from the first position to the second position is restricted, which can reduce the shift from the first position to the second position during water supply.

(12-7)

The water supply port (67) of the humidifier (1) of this embodiment is provided in the tank (60). The tank (60) is turnably supported by the casing (10). When the tank (60) turns, the water supply port (67) shifts between the first position and the second position. Accordingly, the water supply port (67) is shifted between the open state and the closed state simply by turning the tank (60).

(12-8)

The humidifier (1) of this embodiment further includes the stopper (70) configured to restrict the tank (60) from further inclining in the first direction from the first position. The stopper (70) can restrict the tank (60) from inclining further forward in the first direction. As a result, less water in the tank (60) can spill out of the water supply port (67) and the tank (60) and the side door (18) are less likely to be removed together from the casing (10).

(12-9)

The humidifier (1) of this embodiment further includes the overflow control mechanism (K) configured to guide water flowing out of the water supply port (67) to the tray (50). For example, even if water flows out of the water supply port (67) during water supply, the overflow control mechanism (K) can guide the water into the tray (50). Thus, less water can enter the mechanical part inside the casing (10). This can cause less failure in the humidifier (1).

(12-10)

The overflow control mechanism (K) of the humidifier (1) of this embodiment includes the passage (P) between the inner surface of the side door (18) and the first side surface (61*a*), and the pair of guards (19) on the side door (18) along the passage (P) so as to cover both ends of the first side surface (61*a*). The water having spilled out between the side door (18) and the first side surface (61*a*) of the tank (60) can flow through the passage (P) into the tray (50). The water having spilled out on both sides of the first side surface can flow along the inner surfaces of the guards (19) into the tray (50).

(12-11)

The tank (60) of the humidifier (1) of this embodiment is detachable from the casing (10). Water can be supplied with the tank (60) detached. Accordingly, water is supplied in two ways, directly to the tank (60) and with the tank (60) detached.

(12-12)

The tank (60) of the humidifier (1) of this embodiment includes the water supply valve (66) communicating with the tray (50). The tray (50) is supplied with water when the water supply valve (66) is open, and supplied with no water when the water supply valve (66) is closed. The water supply valve (66) of this embodiment is opened and closed by the contact portion (54) of the float (51) which moves up and down depending on the water level of the tray (50). Accordingly, when the water level of the tray (50) becomes relatively low, the water supply valve (66) is open to supply water from the tank (60) to the tray (50). When the water level of the tray (50) reaches the full level, the water supply valve (66) is closed, allowing less water to flow out of the tray (50).

(12-13)

The water supply port (67) of the humidifier (1) of this embodiment includes the inflow port (67*a*) through which water flows in, and the outflow port (67*b*) through which the water having flowed in through the inflow port (67*a*) flows into the tank (60). The outflow port (67*b*) has a smaller opening area than the inflow port (67*a*). In this manner, the outflow port (67*b*) smaller than the inflow port (67*a*) allows less water having flowed into the tank (60) to splash and spatter out of the water supply port (67).

(13) Other Embodiments

The foregoing embodiment may be modified as follows.

The water supply port (67) of the humidifier (1) may be separated from the tank (60). The water supply port (67) only has to communicate between the outside and the inside of the tank (60). The tank (60) and the water supply port (67) may be connected to each other via a member such as a tube. In this case, the water poured through the water supply port (67) flows into the tank (60) through the tube.

The tank (60) of the humidifier (1) may be non-detachable from the casing (10) (i.e., may be fixed to the casing (10)).

The side door (18) of the humidifier (1) may be a transversely opening door. For example, the side door (18) may turn so as to make the right or left end open. The humidifier (1) may have what is called a "drawing structure" where the side door (18) and the tank (60) are drawn out of the casing (10) to expose the water supply port (67) to the outside. In addition, the air purification unit (U2) and the humidifying unit (U3) of this embodiment may have the same configurations as those of the air purification unit and the humidification element, respectively, described in Japanese Unexamined Patent Publication No. 2016-3842 (e.g., FIG. 3A and FIG. 3B).

The stopper (70) of the humidifier (1) may have a damper structure to reduce sudden closure of the side door (18) when shifting from the first position to the second position. For example, this damper structure may be a gear damper. The gear damper includes a gear extending along the left edge of the stopper (70). The gear meshes with an engagement portion (not shown) fixed to the inner side of the front panel (13*a*), which reduces sudden shift of the side door (18) from the first position to the second position. Accordingly, the side door (18) is less likely to be closed by itself due to the weight of the water in the tank (60) during the water supply, and eventually the user is less likely to get any finger caught between the side door (18) and the right side panel (13*c*). In addition, the stopper (70) with such a damper structure does not require the lid member (68) for keeping the first position as in the embodiment described above.

The overflow control mechanism (K) of the embodiment only has to guide the water flowing out of the water supply port (67) to the tray (50) and does not necessarily require the guards (19).

While the embodiment and variations have been described above, it will be understood that various changes in form and details can be made without departing from the spirit and scope of the claims. The above embodiment and variations may be appropriately combined or replaced as long as the functions of the target of the present disclosure are not impaired. The expressions of "first," "second," . . . described above are used to distinguish the terms to which these expressions are given, and do not limit the number and order of the terms.

As described above, the present disclosure is useful for a humidifier.

The invention claimed is:

1. A humidifier comprising:
a casing;
an air passage in the casing;
a humidifying section configured to humidify air flowing through the air passage;
a tray configured to supply water to the humidifying section;
a tank configured to supply water to the tray;
a water supply port communicating with the tank, the water supply port being configured to supply water from outside into the tank;
a door openable and closable, the door being a part of a side surface of the casing; and
an overflow control mechanism configured to guide water flowing out of the water supply port to the tray,
the water supply port
being exposed to outside of the casing,
being disposed inside the door,
being provided in the tank, and
shifting between
a first position in which the water supply port is exposed to the outside of the casing when supplying the water, and
a second position in which the water supply port is housed in the casing when supplying no water,
the door being open in the first position, and closed in the second position,
the tank being turnably supported by the casing, and
the water supply port shifting between the first position and the second position when the tank turns.

2. The humidifier of claim 1, further comprising:
a lid member openable and closable in the water supply port.

3. The humidifier of claim 2, wherein
the lid member shifts to open the water supply port in the first position, and shifts to close the water supply port in the second position.

4. The humidifier of claim 3, wherein
in the first position, the lid member is biased to keep the water supply port open and to restrict a shift from the first position to the second position.

5. The humidifier of claim 1, further comprising:
a restricting member configured to restrict the tank from further inclining in a first direction from the first position, where
the first direction represents a direction in which the tank turns from the second position to the first position, and
a second direction represents a direction in which the tank turns from the first position to the second position.

6. The humidifier of claim 1, wherein
the tank is detachable from the casing.

7. The humidifier of claim 1, wherein
the tank includes an opening and closing mechanism communicating with the tray, and
the tray is
supplied with water when the opening and closing mechanism is open, and
supplied with no water when the opening and closing mechanism is closed.

8. The humidifier of claim 1, wherein
the water supply port includes
an inflow port through which water flows in, and
an outflow port through which water having flowed in through the inflow port flows into the tank, the outflow port having a smaller opening area than the inflow port.

9. A humidifier comprising:
a casing;
an air passage in the casing;
a humidifying section configured to humidify air flowing through the air passage;
a tray configured to supply water to the humidifying section;
a tank configured to supply water to the tray;
a water supply port communicating with the tank, the water supply port being configured to supply water from outside into the tank;
a door openable and closable, the door being a part of a side surface of the casing; and
a lid member openable and closable in the water supply port,
the water supply port
being exposed to outside of the casing,
being disposed inside the door,
shifting between
a first position in which the water supply port is exposed to the outside of the casing when supplying the water; and
a second position in which the water supply port is housed in the casing when supplying no water,
the door being open in the first position, and closed in the second position, and
the lid member shifting to open the water supply port in the first position, and shifting to close the water supply port in the second position.

10. The humidifier of claim 9, wherein
in the first position, the lid member is biased to keep the water supply port open and to restrict a shift from the first position to the second position.

11. The humidifier of claim 9, wherein
the water supply port is provided in the tank,
the tank is turnably supported by the casing, and
the water supply port shifts between the first position and the second position when the tank turns.

12. The humidifier of claim 11, further comprising:
a restricting member configured to restrict the tank from further inclining in a first direction from the first position, where the first direction represents a direction in which the tank turns from the second position to the first position, and a second direction represents a direction in which the tank turns from the first position to the second position.

13. The humidifier of claim 11, further comprising:

an overflow control mechanism configured to guide water flowing out of the water supply port to the tray.

14. The humidifier of claim 13, wherein the tank is disposed with a first side surface of the tank extending along an inner surface of the door, and the overflow control mechanism includes a passage between the inner surface of the door and the first side surface, and a pair of walls on the door along the passage so as to cover both ends of the first side surface.

15. The humidifier of claim 9, wherein the tank is detachable from the casing.

16. The humidifier of claim 9, wherein the tank includes an opening and closing mechanism communicating with the tray, and the tray is supplied with water when the opening and closing mechanism is open, and supplied with no water when the opening and closing mechanism is closed.

17. The humidifier of claim 9, wherein the water supply port includes an inflow port through which water flows in, and an outflow port through which water having flowed in through the inflow port flows into the tank, the outflow port having a smaller opening area than the inflow port.

* * * * *